United States Patent [19]

Chow

[11] 4,264,115

[45] Apr. 28, 1981

[54] INTERSTAGE ELECTRICAL CONNECTOR

[75] Inventor: Weichien Chow, Park Forest, Ill.

[73] Assignee: Bunker Ramo Corporation, Oak Book, Ill.

[21] Appl. No.: 882,482

[22] Filed: Mar. 1, 1978

[51] Int. Cl.[2] ..... H01R 13/62

[52] U.S. Cl. ..... 339/45 M; 339/75 M; 339/143 R

[58] Field of Search ..... 339/17 F, 75 M, 91 L, 339/91 B, 143 R, 176 MF, 45 M, 35, 34, 44 R

[56] References Cited

U.S. PATENT DOCUMENTS

| | | | |
|---|---|---|---|
| 1,060,011 | 4/1913 | Newton | 339/43 |
| 2,700,141 | 1/1955 | Jones | 339/94 M |
| 2,724,093 | 11/1955 | Preston | 339/75 M |
| 3,043,925 | 7/1962 | Wilson | 339/45 M X |
| 3,119,645 | 1/1964 | Abbott | 339/45 M |
| 3,159,444 | 12/1964 | Stine | 339/45 M |
| 3,165,340 | 1/1965 | Kuehl et al. | 339/91 B X |
| 3,241,095 | 3/1966 | Phillips | 339/94 R |
| 3,312,928 | 4/1967 | Nava et al. | 339/91 R X |
| 3,336,562 | 8/1967 | McCormick et al. | 339/45 R |
| 3,345,604 | 10/1967 | Henschen | 339/75 M X |
| 3,360,764 | 12/1967 | Bac | 339/91 B X |
| 3,509,515 | 4/1970 | Acord | 339/45 M |
| 3,519,975 | 7/1970 | Prow et al. | 339/14 P |
| 3,521,222 | 7/1970 | Andrews | 339/193 R |
| 3,535,676 | 10/1970 | Schultz | 339/143 R |
| 3,539,973 | 11/1970 | Awtes | 339/143 R |
| 3,550,065 | 12/1970 | Phillips | 339/94 M |
| 3,573,677 | 4/1971 | Detar | 333/183 |
| 3,656,781 | 4/1972 | Paine | 339/91 B X |
| 3,835,443 | 9/1974 | Arnold et al. | 339/143 R X |

OTHER PUBLICATIONS

"Flush-Mounted Umbilical Connector EMP and RFI Attenuating," J. Morgan Kerr, Jr., Article, *Connector Symposium*, 10-1976.

Rogers Flexible Circuits Catalog, p. 5, 1977, Rogers Corp., Chandlar, Arizona.

*Primary Examiner*—Joseph H. McGlynn
*Assistant Examiner*—Eugene F. Desmond
*Attorney, Agent, or Firm*—F. M. Arbuckle; B. W. Sufrin

[57] ABSTRACT

An electrical connector useful for interconnecting circuits of adjacent guided missile stages and the like includes first and second interengageable housings. Each connector housing supports contact members which are interengageable when the first and second housings are brought into engagement. Actuator means are provided for engaging and disengaging the connector contact members independent of the engagement and disengagement of the connector housings and include a movable insert member disposed within the second housing for movement between mating and non-mating positions. The contact members supported within the second housing each include a terminal portion, an active contact portion carried by the insert member for engagement with a first housing contact member, and an extendable portion for maintaining continuous electrical connection between the active and terminal portions as the insert member is moved between its mating and non-mating positions. The actuator means further include a latching mechanism for moving the insert member to its mating position to securely interengage the connector contact elements, and a separation or quick disconnect assembly for disengaging the connector contact members prior to disengagement of the connector housings.

45 Claims, 19 Drawing Figures

FIG. 5
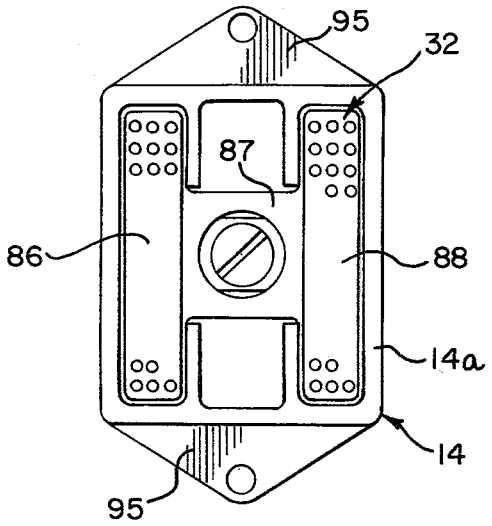
FIG. 6
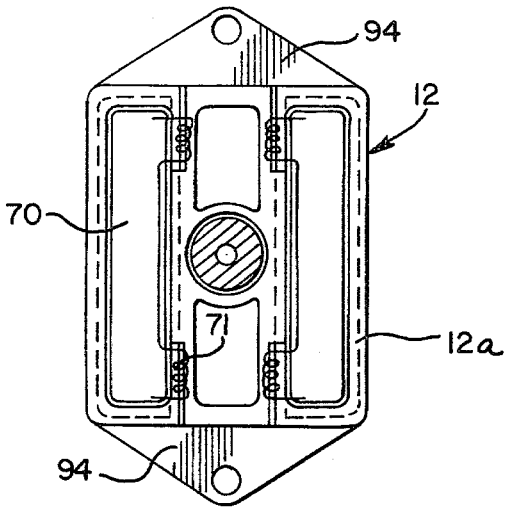
FIG. 7
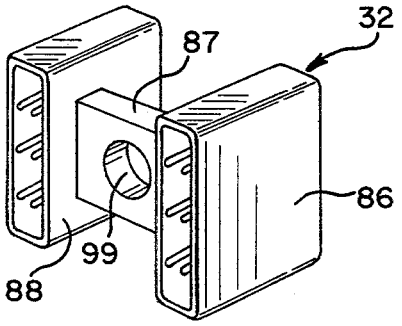
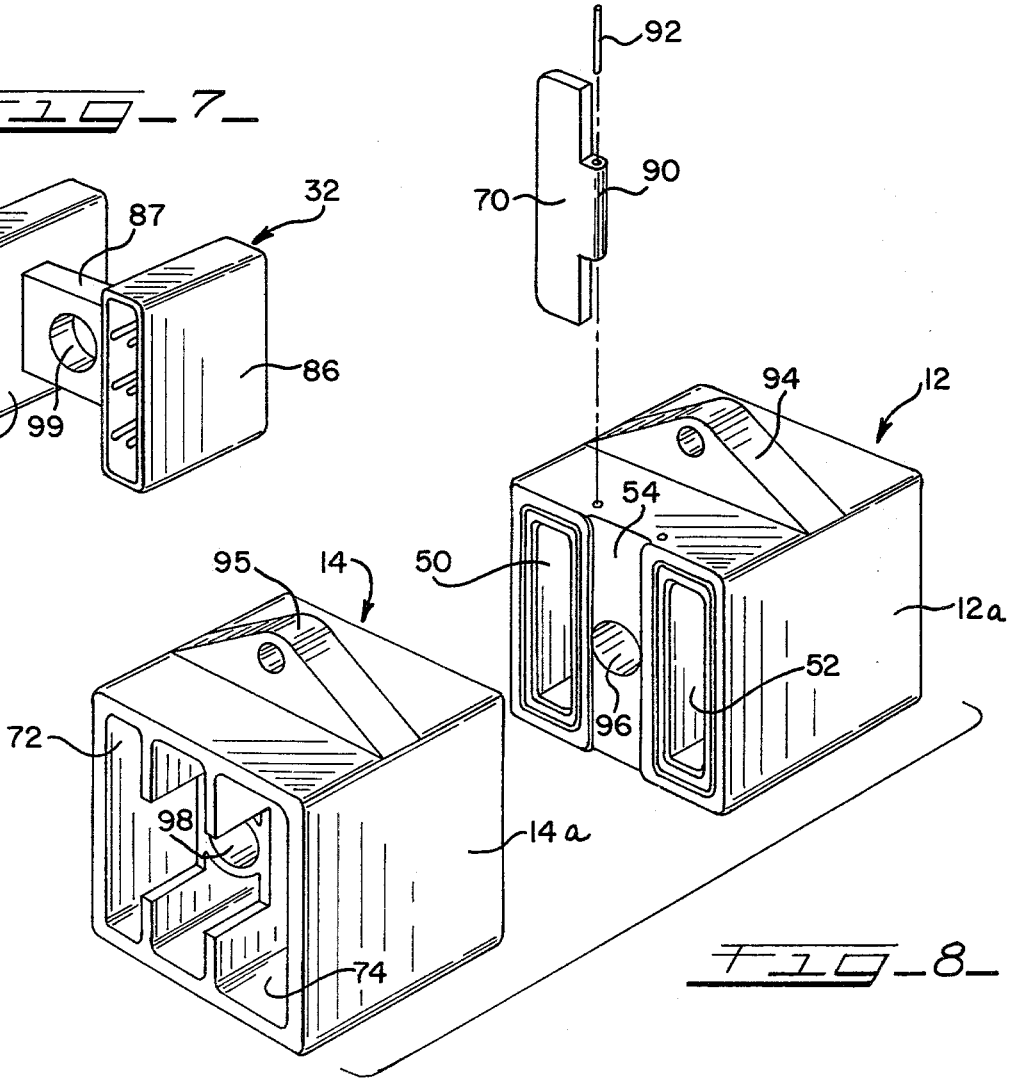
FIG. 8

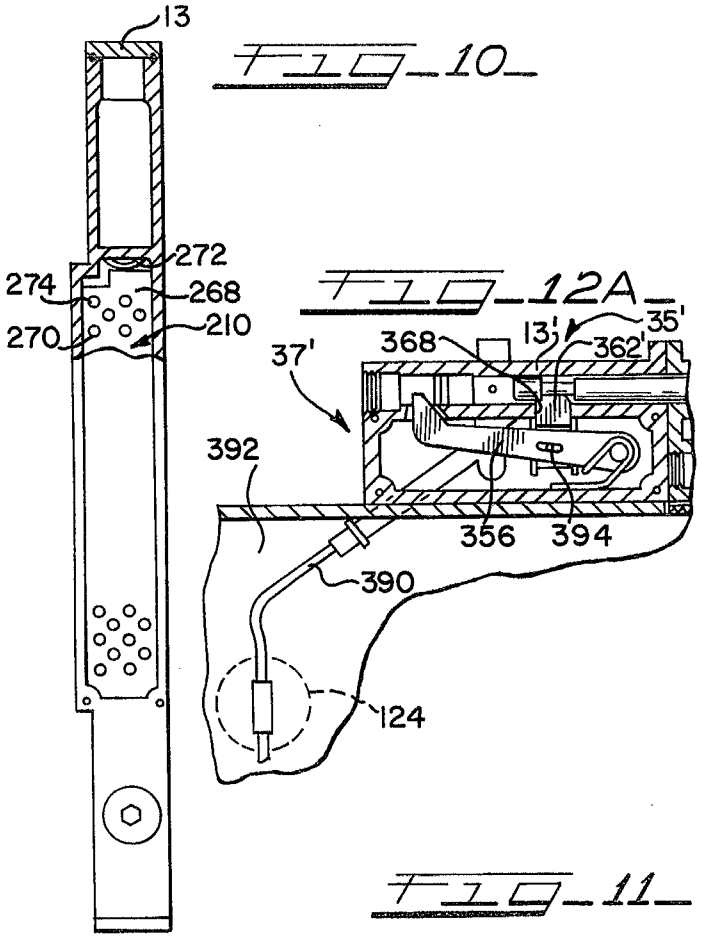
FIG. 10
FIG. 12A
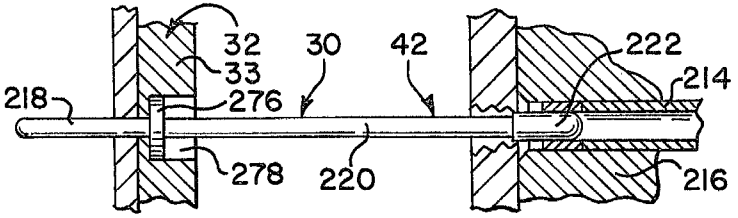
FIG. 11
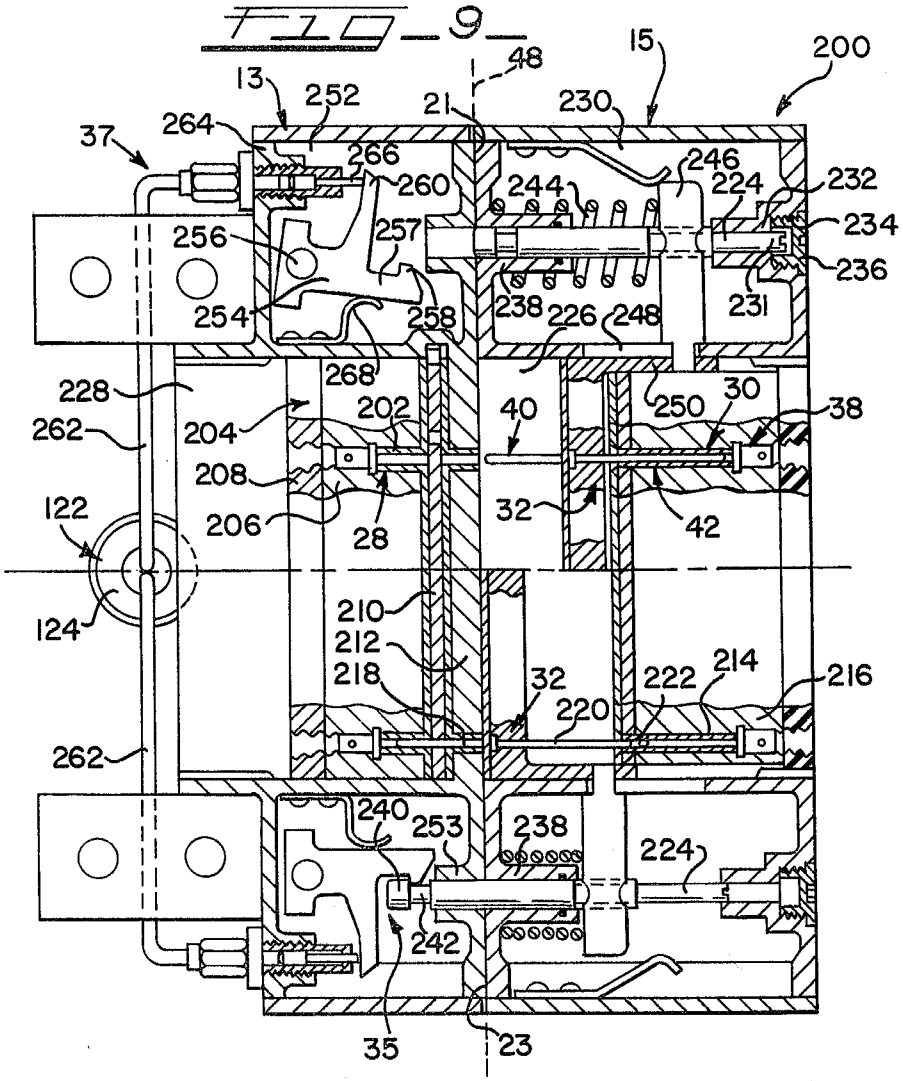
FIG. 9

INTERSTAGE ELECTRICAL CONNECTOR

BACKGROUND OF THE INVENTION

The present invention is generally directed to electrical connectors and more particularly to interstage connectors for interconnecting power and/or signal circuits of adjacent guided missile stages. Specifically, the present invention relates to an electrical connector wherein the contact members supported within the connector component housings may be engaged and disengaged independently of the engagement and disengagement of the housings.

Guided missiles and rocket systems generally include a number of aligned stages for launching and flight control purposes. Prior to in-flight separation of one missile stage from its adjacent and subsequently operative stage, various power and signal circuits of the adjacent missile stages are often electrically interconnected. Electrical interstage connectors are therefore required for performing such electrical connections between the circuits of adjacent missile stages.

Interstage electrical connectors of the above type must satisfy a wide variety of performance requirements. Such requirements include quick disconnection of the interstage connector and its associated electrical circuits, as well as effective shielding of the connector contact members from electromagnetic pulses generated by close proximity of nuclear blasts, electromagnetic and radio frequency interference primarily from radar equipment, and environmental debris and contaminants. Such protection must be effective when the connector is operative as well as after separation of the connector components and missile stages. While many prior interstage electrical connectors do satisfy a variety of these requirements, there is one problem which has not been previously satisfactorily overcome and is associated with the separation of the interstage connector components and missile stages.

A majority of prior interstage connectors utilize pin and socket type electrical contact members which are aligned substantially parallel with the connector's central axis. Thus, the connector contact members must be engaged and disengaged along a line substantially parallel with the central axis of the connector component housings if damage to the contact elements is to be prevented. Furthermore, the housings of such prior connectors are generally adapted to engage and disengage simultaneously with their contact members.

When utilized between two adjacent missile stages, such prior interstage connector housings and contact members were generally arranged for quick disconnection along a plane different from the separation plane of the missile stages. Thus, the manner in which the missile stages separated had minimal effect on the proper separation of the connector housings and contact elements. However, it has been recognized that significant advantages can be achieved if the planes of separation of the interstage connector components and the missile stages are the same. Such advantages include the fact that the connector housings can be arranged within and adjacent the separation surfaces of the two abutting missile stages. In this manner, the mechanism for maintaining the adjacent missile stages in abutting relationship can also be used to maintain the connector housings fully interengaged. Furthermore, factory assembly of the entire missile is simplified and enhanced.

The above referenced problem with prior interstage connectors is that since the contact members thereof are generally adapted to disengage along a line substantially parallel with the central axis of the connector, and the contact members and connector housings are adapted to disengage simultaneously, the connector housings must also be disengaged along such a line. However, when the separation planes of the missile stages and the connector components are the same, the connector housings generally are not disengaged along a line parallel to the axis of the connector, for the lighter, exhausted missile stage and its associated connector housing tend to fall away at an angle relative to the operative missile stage and its associated connector housing. Thus, when the connector housing and contact members are separated simultaneously, the above described tendency of the connector housings to separate along an angular line relative to the connector central axis tends to damage the contact members of the operative missile stage connector component. In certain instances, severe damage can occur to the operative missile stage connector's contact members and/or to the protective shielding therefor.

Such damage to the contact members of the housing disposed in the operative missile stage can be quite harmful in that the power circuits of the various interstage connectors of the entire missile are generally arranged in series. Thus, even though an interstage connector has been disengaged and the missile stages separated, the power line passing through the connector component remaining with the operative missile stage is still part of a circuit connected to the remaining missile stages. If the contact members of this connector housing are damaged, the power circuit may be shorted, and this can result in termination of the power through a line common to some or all the signal and/or power lines of the remaining missile stages. Thus, while the contact members of the connector housing remaining with the operative missile stage are no longer operative with respect to directly receiving a current from another operative missile stage circuit, these contact members must nonetheless remain intact and undamaged. They must also remain shielded from electromagnetic interference, electromagnetic pulses and environmental contaminants. Prior interconnectors do not prevent such damage to the connector contact elements and/or shielding material.

SUMMARY OF THE INVENTION

The present invention, therefore, is directed to an electrical connector particularly useful in missile staging systems and which overcomes the above-described deficiencies and problems of prior electrical connectors and arrangements used for interconnecting the circuits of adjacent guided missile stages and the like.

It is one object of the present invention to provide an electrical connector wherein the contact members of the engaged connector components are engageable and disengageable independently of the engagement and disengagement of the connector component housings.

It is another object of the present invention to provide an electrical connector for interconnecting the circuits of adjacent guided missile stages whereby the electrical connections of the connector can be disengaged prior to separation of connector housings and the missile stages.

A further object of the present invention is to provide an improved interstage electrical connector for guided missiles and the like whereby separation of the connector component housings and the missile stages does not damage the contact elements of the connector component remaining with the operative missile stage.

It is yet another object of the present invention to provide an improved electrical connector for interconnecting electrical circuits of adjacent guided missile stages whereby the contact members of the connector component remaining with the operative missile stage after separation of adjacent stages are shielded from electromagnetic interference, electromagnetic pulses and environmental contaminants prior to, during and after separation of the missile stages and connector housings.

Accordingly, the above and other objects and advantages are achieved with the present invention by providing an electrical connector having first and second interengageable housings. The first connector housing includes a forward fastening portion and first contact means disposed therein. In preferred form, the first connector housing is adapted for mounting within a missile stage or the like with the forward fastening portion adjacent the separation surface of the missile stage. The second connector housing includes a forward fastening end portion which is adapted for engagement with the forward fastening portion of the first housing and includes second contact means supported therein. The second housing is likewise preferably mountable within a missile stage with its forward end portion adjacent the separation surface of the missile stage.

Actuator means are provided within the connector for engaging and disengaging the first and second contact means independently of the engagement and disengagement of the connector housings. In preferred form, the actuator means include a movable insert member disposed within the second housing for movement between a mating position within the forward fastening portion of the first housing, and a non-mating position wherein the insert member is disposed within the second housing.

The second contact means are adapted for electrical engagement with the first contact means when the insert member is in its mating position and the first and second connector housings are brought into engagement. In preferred form, the second contact means includes a terminal portion disposed in the fixed rear of the second connector housing, at least one active contact member carried by the movable insert member, and an extendable portion for interconnecting the active contact member and the terminal portion. The active contact member is adapted for engagement with the first contact means, and the extendable portion maintains continuous electrical connection between the active contact member and the terminal portion as the insert member is moved between its mating and non-mating positions.

In one preferred form, each extendable portion includes an elongated contact member projecting rearwardly from such active contact member for movement with the insert member, and the terminal portion includes at least one elongated socket contact element. Each elongated contact member is adapted for continuous sliding engagement within the terminal socket element as the insert member moves between its mating and non-mating positions.

In another preferred embodiment, the extendable portion includes a flexible conductor which interconnects each active contact member and the terminal portion. In preferred form, the flexible conductor is a flat cable conductor having a plurality of accordian-like folds for accommodating movement of the insert member as it moves between its mating position and its non-mating position. The flat cable conductor includes at least one conductor for interconnecting each active contact member and one terminal contact element in the terminal portion.

The actuator means also includes a latching mechanism whereby the insert member is moved from its non-mating position to its mating position to firmly interengage the first and second contact means. This latching mechanism preferably includes at least one elongated rod member which is extendable from one of the housings into the other housing and has a first latching member disposed on the free extendable end thereof. Disposed in the other housing is a second latching member which firmly engages the first latching member when the rod is extended into the housing. The rod member is adapted so that longitudinal movement thereof in one direction effects movement of the insert member to its mating position to firmly interengage the first and second contact means, the engaged latching members firmly locking the contact means in interengagement.

The actuator means additionally includes separation or quick disconnect means for disengaging the first and second contact means prior to disengagement of the housings. In preferred form, the separation means includes a source for generating a pressurized fluid, preferably gas, duct means for distributing the fluid into the first housing, and driver means actuateable by the fluid for disengaging the latching members and for moving the insert member from its mating to its non-mating position, thereby disengaging the contact means.

Finally, means for shielding the first contact means of the first connector housing from EMP, EMI and environmental contaminants are provided and preferably include a closure means at the forward end of the foward fastening portion which are closeable upon disengagement of the first and second contact means yet prior to disengagement of the housings, and a waveguide member disposed within the first connector housing's forward fastening portion and through which the second contact means pass to engage the first contact means. In one preferred embodiment, an insulating deadface member may also be provided in the forward fastening portion of the first connector housing to aid in providing the required shielding yet adapted to permit electrical engagement of the first and second contact means.

BRIEF DESCRIPTION OF THE DRAWINGS

The novel features which are believed to be characteristic of the present invention are set forth in the appended claims. The invention itself, however, together with further objects and attendant advantages thereof, will become apparent and best understood by reference to the following detailed description taken in connection with the accompanying drawings, setting forth by way of illustration and example certain embodiments of the invention in the several figures of which like reference numerals identify like elements, and in which:

FIG. 5 is a front elevation view of the connector housing casting containing a movable insert member of the connector embodiment illustrated in FIGS. 1 and 3;

FIG. 6 is a front elevation view of the other connector housing casting of the connector embodiment illustrated in FIGS. 1 and 3;

FIG. 7 is a perspective view of one embodiment of a movable insert member for the connector embodiment illustrated in FIGS. 1 and 3;

FIG. 8 is a perspective view, with some parts exploded, of the castings for the connector housings of the connector embodiment illustrated in FIGS. 1 and 3;

FIG. 9 is a sectional view, with some parts in elevation, of yet another embodiment of a connector constructed in accordance with the present invention;

FIG. 10 is a front elevation view with some parts in section of one of the connector housings of the interconnector embodiment illustrated in FIG. 9;

FIG. 11 is an enlarged side elevation view, with some parts in section, of one embodiment of the extendable contact portion of the second contact means constructed in accordance with the present invention;

FIG. 12A is a fragmentary sectional view, with some parts in elevation, of yet another embodiment of the latching and separation or quick disconnect mechanisms constructed in accordance with the present invention;

DETAILED DESCRIPTION OF THE PREFERRED EMBODIMENTS

Figure 1:
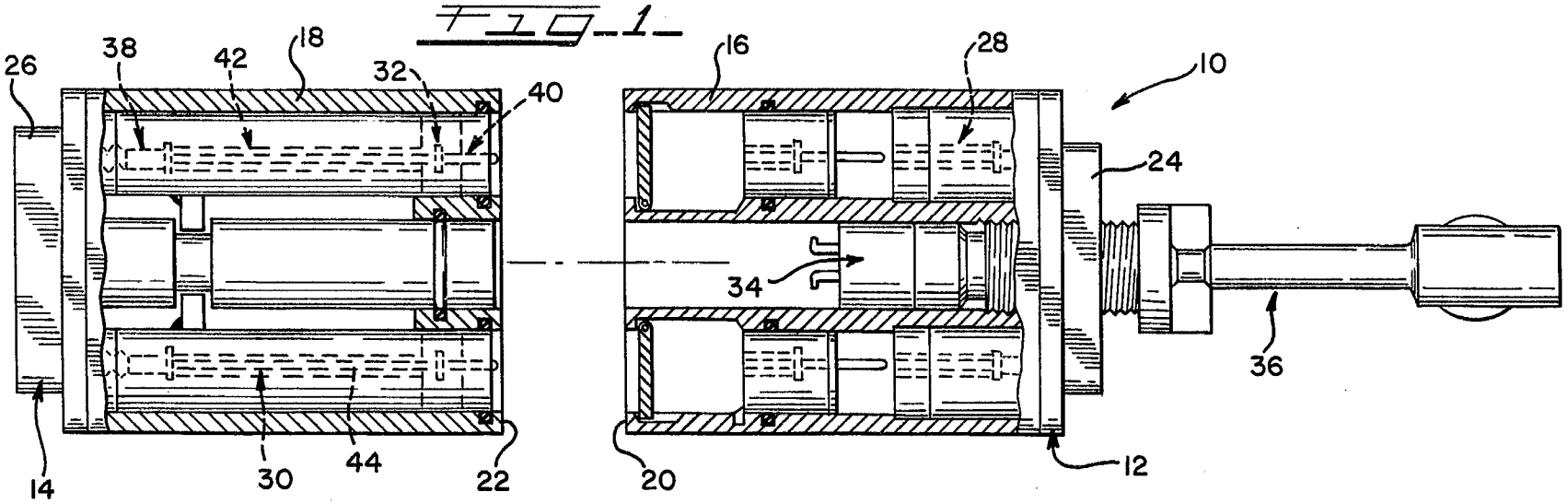
FIG. 1 is a top plan view, with some parts in section, of one embodiment of an electrical connector constructed in accordance with the present invention.
Figure 2:
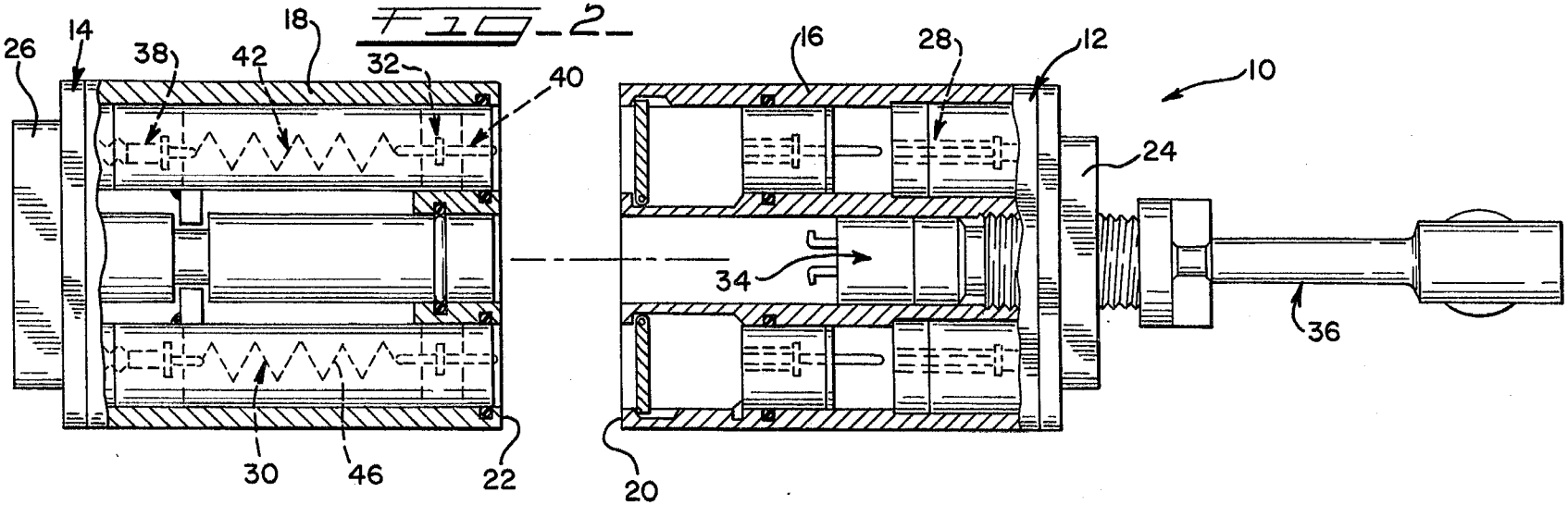
FIG. 2 is a top plane view, with some parts in section, of another embodiment of an electrical connector constructed in accordance with the present invention.

Referring to FIGS. 1 and 2, an interstage connector 10 is provided having a first connector housing 12 and a second connector housing 14 for interconnecting electrical circuits of two abutting guided missile stages (not shown) or the like. In preferred form, the first connector housing 12 is mounted in the missile stage which becomes operative upon separation of the abutting stages, while the second housing 14 is similarly mounted in the other missile stage which terminates operation at the time of missile staging separation. It will be emphasized, however, that the interstage connector 10 may be utilized in any type of electrical circuit connection wherein it is desired that the engagement and disengagement of the electrical circuit connection in the connector 10 be independent of the engagement and disengagement of the housings 12 and 14.

The housings 12 and 14 each have forward fastening end portions 16 and 18 with front engagement surfaces 20 and 22, respectively. The housings 12 and 14 are sized and shaped to interengage each other at the front surfaces 20 and 22. In the illustrated embodiment, such engagement takes the form of aligned abutment of the surfaces 20 and 22. It will be appreciated, however, that the housings 12 and 14 can be engaged in any known manner such as telescoping mating engagement, pin and socket aligned engagement, and the like. Furthermore, for the purposes of the present invention, engagement of the housings 12 and 14 need not even be limited to actual contact of the surfaces 20 and 22, although actual abutting contact is preferred.

The housing 12 also includes a back shell portion 24 as well as lead cables (not illustrated) which carry conductors which are connected to the contact means within the housing 12. Likewise, the connector housing 14 includes a back shell portion 26 and lead cables (not illustrated) which carry conductors for the contact means disposed within the housing 14.

Supported within the first housing 12 are first contact means 28, while second contact means 30 are supported within the second housing 14. The connector 10 also includes actuator means for interengaging and disengaging the contact means 28, 30 independent of the engagement and disengagement of the housings 12, 14. The actuator means include a movable insert member 32 disposed within the second housing 14 for movement between mating and nonmating positions and as described in greater detail below. The actuator means also include a latching mechanism designated generally at 34 which is adapted to move the insert member 32 to its mating position to interengage the contact means 28 and 30 and securely maintain such interengagement, and a separation or quick disconnect assembly shown generally at 36 for disengaging the contact means 28, 30 prior to disengagement of the connector housings 12, 14.

The second contact means 30 in the housing 14 include a terminal portion 38 which is fixed to the rear of the housing 14. An active contact portion 40 is also provided and is carried by the insert member 32. The active portion 40 is adapted for engagement with the contact means 28 when the insert member 32 is in its forward mating position. Finally, an extendable portion 42 maintains continuous electrical connection between the active contact portion 40 and the terminal portion 38 as the insert member 32 is moved between its mating and non-mating positions. As illustrated in FIGS. 1 and 2 and more particularly described below, the extendable portion 42 may preferably take the form of a pin and socket arrangement 44 or a flexible conductor 46.

As previously, mentioned, the connector housings 12 and 14 are mounted in their respective missile stages or the like. In the preferred form, the connector housings 12 and 14 are arranged so that their forward surfaces 20 and 22 are adjacent or flush with the abutting surfaces of the two adjacent missile stages. When the missile stages are then assembled together the housings 12 and 14 become engaged. In this manner, the plane of separation of the missile stages, which is defined as the plane between the abutting surfaces of the two missile stages, is the same as the plane of separation between the housings 12 and 14. Thus, the housings 12 and 14 may be maintained in engagement by the mechanism utilized to mount the missile stages together, and the housings 12 and 14 separate simultaneously with and in the same manner as the adjacent missile stages in which they are embedded.

Referring to FIGS. 3, 3A and 5–8, wherein the embodiment of FIG. 1 is illustrated in greater detail, the housings 12 and 14 are shown joined together along a plane of separation illustrated by the broken line 48. The housing 12 preferably includes two substantially identical inner cavities 50 and 52 separated by a center support member 54. Each cavity 50, 52 includes the contact means 28, which in this embodiment includes a plurality of socket contact elements 56 embedded in a fixed rear monoblock 58. A waveguide 60 is disposed for shielding purposes about the open ends of the socket elements 56 and is similar to other waveguides to be described in greater detail below. The terminal socket element 56 is electrically connected to lead conductors (not illustrated) which are engaged with the electrical circuit of the respective missile stage. In this particular embodiment, an intermediate contact 62 is provided within a slidable deadface member 64. The deadface member 64 is slidable within the cavity 50, 52, and the intermediate contact 62 consists of a socket portion 66, which is adapted to receive the contact means 30 of the second connector 14, and a pin portion 68, which is adapted to be slidably engageable within the socket element 56. The deadface 64 is for the purpose of reducing the distance of travel required for the contact means 30 as well as for providing additional attenuation of electromagnetic interference with respect to the socket contact element 56.

A closure door 70 is disposed in the forward portion of each cavity 50, 52 and is hinged for pivotingg movement therewithin. As can be seen from FIGS. 3 and 6, each door 70 is maintained by a spring member 71 in biased closed position when the contact means 28, 30 are not engaged, and is moved to an open position as the insert member 32 is moved to its mating position. The doors 70 provide shielding against electromagnetic pulses, electromagnetic interference, and prevent the entrance of environmental contaminants and debris into the cavities 50, 52. U.S. Patent application Ser. No. 743,302, assigned to the assignee of the present invention, now abandoned, discloses further details regarding the closure doors 70.

The second connector component 14 also includes two substantially identical cavities 72 and 74, each of which contains the contact means 30. In this particular embodiment, each cavity 72, 74 includes a monoblock 76 in which the terminal portion 38 of the contact means 30 is embedded. Preferably, the terminal portion 38 includes a plurality of elongated socket members 78 which are electrically connected to the circuitry of the respective missile stage by lead conductors (not illustrated). The active contact portion 40 of the contact means 30 includes a plurality of pin members 80 embedded in the insert block 33 of the insert member 32 and extending forwardly therefrom. The extendable portion 42 includes a plurality of elongated pins 82 which are rearward extensions of the pin members 80 and project from the insert block 33 into the elongated terminal sockets 78. At the terminal end of each pin 82 is an electrical contact portion 84 which continuously remains in physical and electrical contact within the socket member 78 as the insert member 32 moves between its mating and non-mating positions. Thus, the elongated pin 82 and its terminal portion 84 maintain the electrical connection between a terminal socket member 78 and an active contact pin member 80 regardless of the position of the insert member 32.

Figure 3:
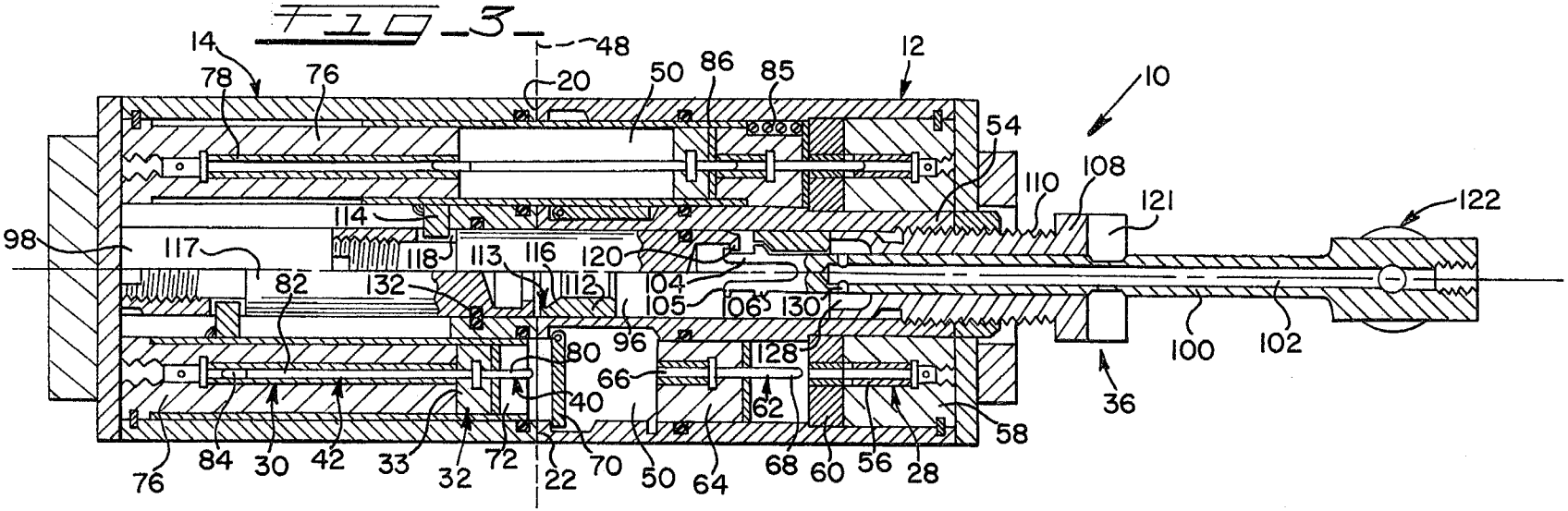
FIG. 3 is a partial sectional view of the embodiment illustrated in FIG. 1 and showing the contact elements of the connector in both engaged and disengaged positions.

The insert member 32, as particularly seen in FIG. 7, in one form includes two monoblock shells 86 and 88 which are interconnected by a support member 87 and adapted for sliding movement within the cavities 72, 74. Disposed within each shell 86, 88 is the insert block member 33. As illustrated in FIG. 3, the insert member 32 is in its non-mating position when it is disposed within the connector husing 14 with the pins 80 recessed within cavities 72, 74 relative to the front face 22. When the connector housings 12 and 14 are abuttingly engaged, the contact means 28 and 30 may then be interengaged by moving the insert member 32 forwardly into the cavities 50, 52 to fully extend the elongated pin members 82. The insert member 32 is then in its mating position. During this movement of the insert member 32, the pin member 80 engages the socket 66 in deadface 64 and moves the deadface 64 to engage the pin 62 with the terminal socket element 56. In this manner, the terminal socket elements 56 become electrically engaged with the pins 80 which remain electrically connected to the terminal socket 78. The insert member 32 is moved in the above manner by the latching mechanism 34, to be described in greater detail below.

Immediately prior to disengagement of the housings 12 and 14 and their respective missile stages, the contact means 28 and 30 are disengaged by movement of the insert member 32 from its mating position to its non-mating position. Such movement first disengages the pin 62 from socket member 56 with the aid of a deadface spring 85, and subsequently disengages the pin member 80 from the socket 66. This disengagement movement of the insert member 32 is effected by the separation mechanism 36 to be described below. After the insert member 32 has reached its non-mating position wherein the connector housings 12 and 14 and their components are on opposite sides of the separation plane 48, separation of the connector housings 12 and 14 may be effected along any line relative to the central axis of the connector 10 without causing damage to the contact means 28 or affecting the shielding thereof.

Referring in more detail to FIGS. 5-8, the first connector housing 12 preferably includes an aluminum casting body **12*a* which defines the cavities 50 and 52. As can be particularly seen from FIG. 8, each door 70 is recessed within the cavity 50 or 52 for closure against the inner surface of the front face 20 and is secured to the casing body 12*a* by a hinge 90 and a hinge pin 92. The second connector housing 14 also preferably includes an aluminum casting body 14*a* which defines the cavities 72 and 74 in which the insert member 32 is disposed. Mounting members 94 and 95 are secured respectively to the casting bodies 12*a* and 14*a* and may be utilized for mounting the connector housings 12 and 14 within their respective missile stages. In alternate embodiments, the mounting members 94 and 95 may be used to firmly engage the housings 12 and 14** with each other.

A longitudinal bore 96 is provided in the casting body 12*a* along the central axis thereof. Likewise, a similar longitudinal bore 98 is provided along the central axis of the casting body 14*a*. When the insert member 32 is disposed within the cavities 72, 74, the bore 99 in the center of the support member 87 is aligned with the bore 98. The bores 96 and 98 are positioned for axial alignment when the housings 12 and 14 are engaged and provide an annular channel for movement of the latching mechanism 34 to control movement of the insert member 32 and the engagement and disengagement of the contact means 28, 30.

Referring again to FIG. 3, the latching means 34 are provided for moving the insert member 32 from its non-mating to its mating position to engage the contact means 28 and 30 with each other. In addition, the latching means 34 maintains the contact means 28 and 30 in firm engagement. In this particular embodiment, the latching means 34 include an elongated member consisting of a tubular rod 100 having a central axial passageway 102 extending substantially the length thereof. The rod 100 is positioned within the bore 96 and is adapted for axial extension therealong into the bore 98 when the housings 12 and 14 are engaged. Disposed on the extendable free end of the rod 100 is a latch 104 having an end hook 105 and a projection 106 disposed rearwardly of the end hook 105. Disposed about the rod 100 rearwardly of the latch 104 is a jack screw 108 having threads 110 thereon. The jack screw 108 is threadably engageable with the interior of the rear portion of the bore 96 so that the jack screw 108 extends into the bore 96. The rod 100 is freely longitudinally movable within the jack screw 108, which acts as a guide for the rod 100. Disposed about the rear portion of the latch 104 rearwardly of the projection 106 and forwardly of the interior end of the jack screw 108 is a cylindrical fly sleeve 112. The outer surface of sleeve 112 is slidably engageable with the interior of the bore 96 and is longitudinally movable therewithin between the forward end of the jack screw 108 and the forward surface 20 of the housing 12. Disposed on the forward end of the sleeve 112 is an annularly notched portion 113 having a ramp surface 116 angled annularly inwardly toward the rear portion of the housing 12. The notch 113 and the ramp surface 116 act as a cam against the projection 106 to move the latch 104 annularly inwardly to permit movement of the insert member 32 as described below.

Referring to the housing 14, a tongue member 114 projects annularly inwardly into the bore 98 from the shell 86. A central tube 117 is disposed within the bore 98 and includes a recessed area 118 into which the tongue 114 projects. The central tube 117 is longitudinally movable within the bore 98 so that as the tube 117 is moved forwardly toward the forward face 22, the tongue 114 is moved simultaneously therewith, and as the tongue 114 is moved forwardly, the insert member 32 is similarly moved. Thus, by movement of the tube 117 within the bore 98, the insert member 32 may be moved between its mating and non-mating positions. Disposed on the forward end of the tube 117 is an annularly inwardly projecting lip 120. As illustrated in FIG. 3, the lip 120 is adapted for engagement with the end hook 105 of the latch 104.

To move the insert member from its non-mating to its mating position and to firmly interengage the contact means 28, 30, the rod member 100 is moved longitudinally forwardly within the bore 96 and into the bore 98 until the end hook 105 of the latch 104 engages the lip 120 of the tube 117. The rod member 100 is then moved back toward the rear of the connector housing 12 until the projection 106 engages the notch 113 and the rear of the sleeve 112 abuts the forward end of the jack screw 108. When the rod member 100 has been so moved, the contact means 28 and 30 are fully engaged such that the pin 80 is fully engaged within the socket 66, the deadface 64 has moved into abutting engagement with the waveguide 60, and the pin 62 is fully engaged within the terminal socket element 56. The rod member 100 is maintained in this position by a coupling nut 121. Thus, the housings 12 and 14 may be fully engaged, yet the insert member 32 may remain in its non-mating position to prevent premature engagement of the contact means 28, 30. This feature of the invention is advantageous when assembling a missile in that the possibility of current flowing through the interstage connectors is prevented until such time that the missile is being prepared for launching. At such time, the rod member 100 may then be moved automatically or manually in the aforementioned manner to move the insert member 32 to its mating position and thereby fully engage the contact means 28 and 30.

Figure 3A:
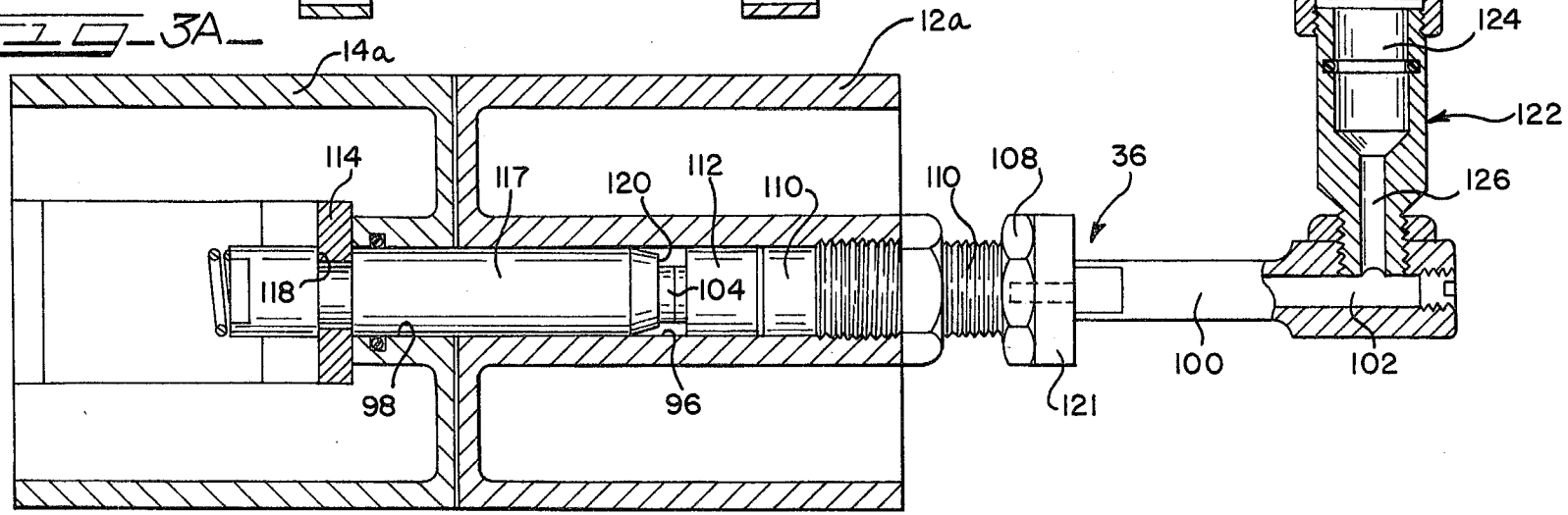
FIG. 3A is a partial sectional view of the connector illustrated in FIG. 3, with some parts in elevation, illustrating the latching and separation mechanisms of one connector embodiment constructed in accordance with the present invention.

The separation assembly 36 is provided for quickly disengaging the contact means 28,30 independently of the disengagement of the connector housings 12 and 14. With this feature, the contact means 28 and 30 may be physically disengaged to terminate the circuit therebetween prior to separation of the housings 12 and 14 and their respective missile stages. In one preferred form as illustrated in FIGS. 3 and 3A, the separation or quick disconnect assembly 36 includes a source 122 for generating a pressurized fluid. In preferred form, the source 122 includes a squib 124 for generating pressurized gas. Any type of standard explosive material for generating the pressurized, expanding gas may be utilized in the squib 124 so long as a relatively large volume of gas is generated in a relatively short period of time. The squib 124 is mounted to the rearward end of the rod 100 with a duct 126 communicating with the passageway 102. Thus, when the explosive charge within the squib 124 is ignited, the pressurized gas resulting therefrom passes from the duct 126 into the passageway 102.

Disposed at the forward end of the jack screw 108 is a recessed chamber 128 through which the rod 100 passes. The chamber 128 is enclosed at its forward end by the rearward face of the sleeve 112 when the contact means 28, 30 are engaged. When the sleeve 112 is located forwardly within the bore 96, as when the insert member 32 is in its non-mating position, the chamber 128 is in communication with the interior of the bore 96. A port 130 is provided between the passageway 102 and the chamber 128 to permit free flow of gas into the chamber 128, the gas expanding as it enters the chamber 128.

To disengage the interengaged contact means 28, 30, the explosive charge in the squib 124 is ignited thereby creating pressurized gas which passes into the chamber 128. Upon expansion of the gas in the chamber 128, the pressure therefrom forces the sleeve 112 forward to cam the ramp surface 116 of the notch 113 against the projection 106 of the latch 104. This forces the latch 104 annularly inwardly to disengage the end hook 105 from the lip 120 of the tube 117. After disengagement of the hook 105 and the lip 120, the sleeve 112 is propelled forwardly within the bore 96 due to the expanding gas from the chamber 128 entering the bore 96 behind the sleeve 112. When the sleeve 112 contacts the forward end of the tube 117, it forces the tube 117 rearwardly into the bore 98 until the insert member 32 is in its non-mating position, the tube 117 being completely withdrawn into the bore 98. When the tube 117 is so withdrawn into the bore 98, a C-ring 132 or the like interconnects the tube 117 and the casing body 14*a*, thereby preventing accidental forward movement of the tube 117 back into the bore 96. In this manner, the contact means 28, 30 are completely disengaged, and the contact means 30 of the housing 14 are completely withdrawn from the plane of separation 48. Thus, the housings 12 and 14 are free to be disengaged with the missile stages along any line of separation without affecting the contact means 28. It should be noted that upon withdrawal of the contact means 30 from the bore 96, the doors 70 automatically close to seal the cavities 50 and 52, thereby shielding the contact means 28 and preventing contamination thereof by environmental debris when the housings 12 and 14 are subsequently separated.

Figure 4:
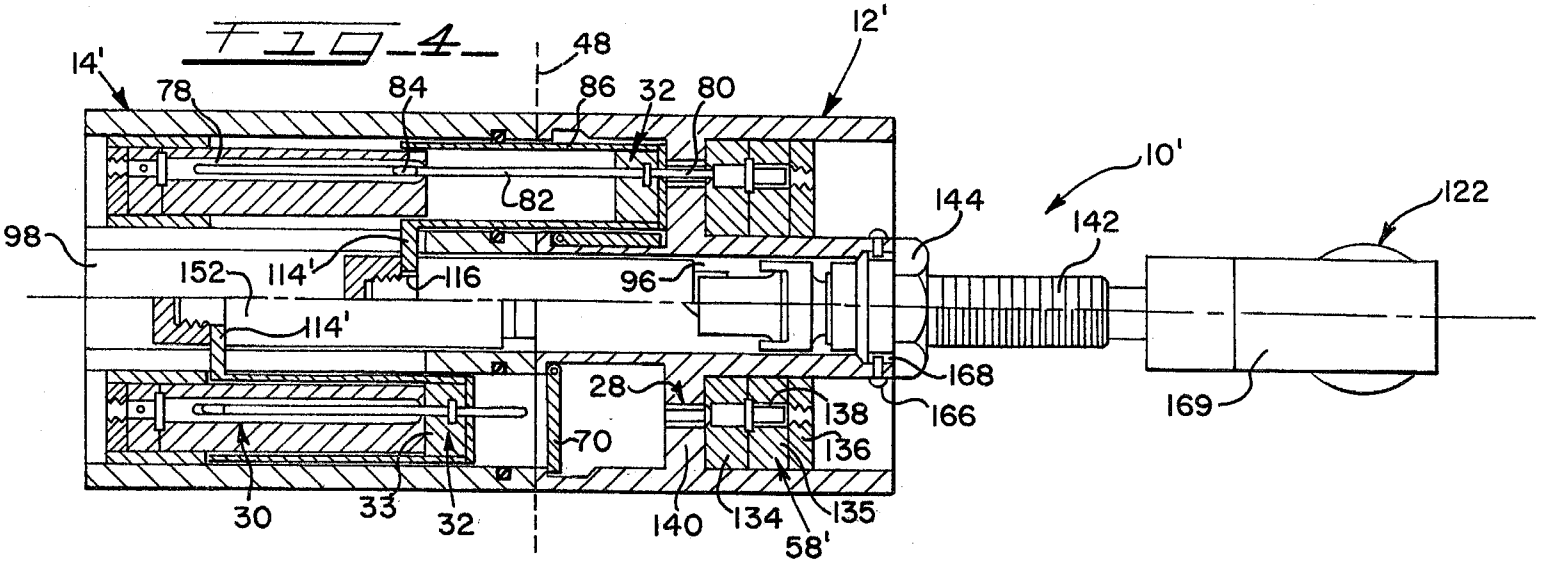
FIG. 4 is a partial sectional view of another connector embodiment constructed in accordance with the present invention and illustrating the contact means in both engaged and disengaged positions.
Figure 4A:
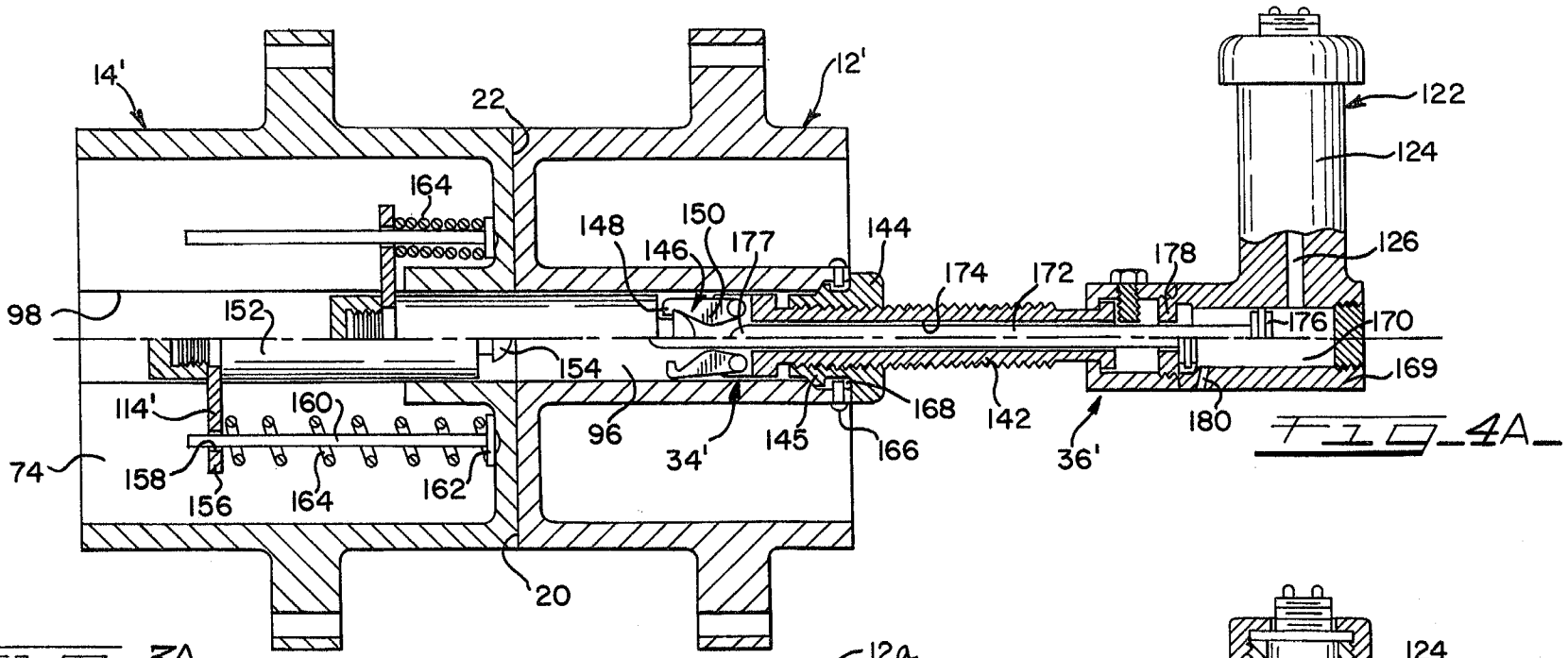
FIG. 4A is a partial sectional view of the connector illustrated in FIG. 4 and showing another embodiment of the latching and separation or quick disconnect mechanisms of the present invention with the contact means in both engaged and disengaged positions.

Referring to FIGS. 4 and 4A, a slightly different embodiment of an interstage connector 10' is illustrated. It should be emphasized that throughout the specification, like numerals indicate like parts. Furthermore, only those portions of the embodiments illustrated in FIGS. 4 and 4A and in subsequent Figures which are different from those illustrated in FIGS. 3 and 3A will be discussed in detail, the remaining parts being the same and functioning in the same manner. As illustrated in FIGS. 4 and 4A, the connector 10' includes first and second interengageable housings 12' and 14', respectively. The second connector housing 14' includes contact means 30 which are substantially identical to the contact means of the embodiment of FIGS. 3 and 3A. The contact means 28 of the first housing 12', however, differ somewhat and include a terminal socket monoblock 58' which is composed of two insulation blocks 134 and 135 and a rubber grommet 136, all bonded together to form a single unit. A plurality of terminal socket members 138 are embedded in the monoblock 58', and a waveguide 140 integral with the housing 12' surrounds the entrance portion of each socket member 138. In this particular embodiment, housing 12' does not include the deadface structure 64 of the prior embodiment thereby permitting the housing 12' to be shortened in length. The manner of operation of the insert member 32 for engaging the contact means 30 with the contact means 28 is substantially the same as that described for FIG. 3.

The latching mechanism indicated generally at 34' of the embodiment illustrated in FIGS. 4 and 4A includes an extendable rod member 142 which is positioned within the bore 96 of the first connector 12' and is axially movable therewithin and into the bore 98 of the second connector 14'. The rod 142, however, is threaded along the exterior surface thereof and is engageable with a nut 144 having a shaft portion 145 which is insertable within the rear opening of the bore 96. It should be noted, however, that the shaft 145 is not inserted into the bore 96 until the contact means 28 and 30 are fully engaged. A latch member 146 is disposed on the free, extendable end of the rod 142 and includes an inwardly projecting end hook 148 and a camming portion 150.

An axially movable tubular member 152 is disposed within the bore 98 and is extendable into the bore 96 when drawn therein by the rod member 142. Disposed on the forward end of the tubular member 152 is a latching knob 154 which is engageable with the end hook 148 of the latch 146. A tongue 114' projects from the insert member 32 into the bore 98 for interengagement with the tubular member 152 similar to the tongue 114 of the embodiment illustrated in FIG. 3. However, the tongue 114' includes an extended portion 156 which has an orifice 158 therein. A rod 160 is disposed within the cavity 74 in parallel alignment with the tubular member 152 and is secured to and extends rearwardly from the inner surface of the forward end 22 of the housing 14'. The rod 160 passes through the orifice 158 so that the extended portion 156 of the tongue 114' is slidable along the rod 160. Disposed between the fixed forward end 162 of the rod 160 and the tongue 114' is a resilient spring member 164 which is adapted to be fully extended between the tongue 114' and the end 162 when the insert member 32 is in its non-mating position. As the tubular member 152 and the insert member 32 are moved forwardly in the manner described below, the spring member 164 is compressed to exert a rearward bias force on the tongue 114' and its extension portion 156.

To move the insert member 32 from its non-mating to its mating position, the rod 142 in the first housing 12' is extended longitudinally forwardly within the bore 96 into the bore 98 until the end hook 148 of the latch 146 engages the latching knob 154 on the tubular member 152. The rod 142 is then moved in an opposite direction to move the insert member 32 and the tubular member 152 into the first connector housing 12', thereby positioning the insert member 32 in its mating position and interengaging the contact means 28 and 30. Once the contact means 28, 30 have been so engaged, the nut 144 is threaded about the rod 142, and its shaft 145 is tightly secured within the bore 96. Pins 166 are then inserted through an aperture in the housing 12' and into a recessed portion 168 of the shaft 145 to insure that the nut 144 and the rod 142 are locked in place, thereby firmly and securely maintaining the interengagement of the contact means 28 and 30.

The separation mechanism 36' of the embodiment illustrated in FIGS. 4 and 4A also preferably includes a squib 124 as previously described. A duct 126 extends from the squib 124 into a cylindrical chamber 170 defined by a housing 169 wherein the pressurized gas generated by the squib 124 expands. An elongated piston rod 172 is disposed for movement within a central passageway 174 of the rod 142 and extends into the chamber 170. The rearward end of the piston rod 172 includes a piston 176 which is lightly held in place by a shear pin (not illustrated) or the like and is adapted for longitudinal movement within the chamber 170. The forward end 177 of the piston rod 172 is curbed and adapted for camming engagement with the camming surface 150 of the latch 146. When the insert member 32 is in its mating position, the piston rod 172 is disposed rearwardly from the latch 146 within the passageway 174.

To disengage the latch 146 from the latching knob 148 and move the insert member 32 to its non-mating position to disengage the contact means 28, 30, the explosive charge in the squib 124 is ignited. The gas generated thereby expands into the chamber 170 which moves the piston 176 forwardly against the forward stops 178. This movement of the piston 176 forces the piston rod 172 forwardly within the passageway 174 to contact the forward end 177 against the camming surface 150 of the latch 146. This camming contact forces the latch 146 to pivot annularly outwardly to disengage the end hook 148 from the latching knob 154. Immediately upon such disengagement, the bias pressure from the compressed spring 164 against the bracket 114' forces the tube member 152 to move rearwardly within the bore 98 so as to move the insert member 32 to its non-mating position. It should be noted that excess gas generated by the squib 124 after the piston 176 has moved against the stop members 178 escapes the chamber 170 by way of valve port 180. In this particular embodiment, therefore, the means for moving the insert member from its mating to its non-mating position is internal within the connector 10', whereas such means in the embodiment illustrated in FIGS. 3 and 3A are external relative to the connector 10.

Referring now to FIGS. 9 and 10, a further embodiment of an interstage connector constructed in accordance with the present invention is illustrated. The basic concept wherein the extendable portion 42 of the contact means 30 includes elongated pin and socket arrangements is the same in the connector 200 of FIG. 9 as in the previously described connectors 10 and 10'. The basic differences between the embodiment of FIG. 9 and the prior embodiments are the latching and separation or quick disconnect mechanisms 35 and 37, respectively.

In this illustrated embodiment, the connector 200 includes first and second connector housings 13 and 15. The first housing 13 includes a plurality of terminal socket elements 202 embedded in a fixed monoblock 204 consisting of an insulating block 206 bonded to a rubber grommet 208. A closure mechanism 210, as described in detail below, is disposed forwardly of the socket elements 202, and a waveguide 212 is provided at the forward face 21 of the housing 13.

The second connector housing 15 includes second contact means 30. In a preferred form, the contact means 30 includes a terminal portion 38 consisting of a plurality of elongated socket members 214 embedded in a fixed monoblock 216. The active contact means 40 includes a plurality of pin contact members 218 which extend forwardly of the movable insert 32. The extendable portion 42 includes a plurality of elongated pin members 220 which are extensions of the pin members 218 and project rearwardly from the insert member 32 for engagement within the socket members 214. Each pin member 220 includes a pin terminal portion 222 which is maintained in continuous electrical engagement within the socket 214 regardless of the position of the insert member 32. Therefore, electrical connection is continuously maintained between the active contact pins 218 and the terminal socket members 214 as the insert member 32 is moved between its mating and non-mating positions, both of which are illustrated in FIG. 9.

As in the previous embodiments, the actuator means includes the insert member 32, the latching mechanism 35, and the separation or quick disconnect assembly 37. In this embodiment, both latching and separation mechanisms 35 and 37, respectively, are disposed about the periphery of the central cavities 228 and 226 of the connector housings 13 and 15, respectively. The latching mechanism 35 includes a pair of extendable rods 224 disposed on either side of the single central cavity 226 in the housing 15. The rear portion 231 of each rod 224 is disposed for longitudinal movement within a cylindrical rear housing 232 which communicates with the exterior of the housing 15 through a threaded orifice 234. A threaded plug member 236 is engageable within the orifice 234 to selectively seal the exterior entrance to the cylindrical housing 232. However, the plug 236 may be removed to gain access to the rear portion 231 of the rod member 224.

Each rod member 224 is disposed in a peripheral cavity 230 and extends longitudinally therewithin from the housing 232 to a second cylindrical housing 238. The second housing 238 projects rearwardly from the forward face 23 of the housing 15. The forward portion of the rod 224 includes a knob 240 which is defined by an annular groove 242 formed in the rod 224. Secured to the rod member 224 intermediate the housings 232 and 238 is a bracket 246 which depends therefrom through a slot 248 in a wall of the housing 15 between the cavities 230 and 226. The bracket 246 projects into the cavity 226 and is securely mounted to a shell portion 250 of the insert member 32. Thus, the bracket 246 interconnects the rod 224 with the insert member 32 for simultaneous movement within the housing 15. A resilient spring member 244 surrounds the rod 224 and extends between the base of the housings 238 and the bracket 246. The spring member 244 is adapted to be in a fully extended position when the insert member 32 is in its non-mating position to maintain the rod 224 completely within the cavity 230 such that the knob member 240 does not project beyond the plane of separation 48.

Cavities 252 are disposed within the first connector 13 on either side of the central cavity 228. Projecting within each cavity 252 is a cylindrical housing 253 which is coaxial with the housing 238 when the first and second connector housings 13 and 15 are engaged. The housing 253 is adapted to receive the rod 224 when it is extended forwardly therethrough as the insert member 32 is moved to its mating position. A latch 254 is also disposed within the cavity 252 and is mounted for pivoting movement about a pin 256. Disposed on the outer end of the latch 254 is an arm 257 having end hook 258 adapted for engagement with the annular groove 242 and the knob 240 when the rod 224 is extended into the housing 13. The latch 254 also includes an arm 260 which projects at a substantially right angle to the arm 257 and is utilized in the separation mechanism 36' of this particular embodiment.

To engage the contact means 28 and 30 once the housings 13 and 15 have been interengaged, the plug 236 is removed from the orifice 234. A tool of any appropriate size is then inserted through the orifice 234 to force the rod 224 forwardly against the bias of the spring 244. This action moves the knob 240 through the housing 253 until the end hook 258 of the latch 254 engages the notch 242 to firmly hold the rod 224 in position. This forward movement of the rod 224 moves the insert member 32 from its non-mating to its mating position to engage the pins 218 with the terminal socket members 202 and also compresses the spring member 244 as illustrated in the lower portion of FIG. 9.

To disengage the contact means 28 and 30 by moving the insert member 32 from its mating to its non-mating position, the separation or quick disconnect mechanism 37 is provided. In this illustrated embodiment, the separation mechanism 37 includes a source 122 for generating a pressurized fluid, preferably gas. In the preferred form, the source 122 is a squib 124 of the type described above. Ducts 262 are provided for directing the pressurized gas from the squib 124 to each cavity 252. Mounted in the rear portion of each cavity 252 is a piston housing 264 which contains an extendable piston pin 266 therein.

When the explosive charge of squib 124 is ignited, the pressurized gas therefrom passes through the ducts 262 and into the piston housing 264 wherein the gas forces the piston pin 266 longitudinally forwardly to engage the arm 260 of the latch member 254. This engagement forces the arm 260 to rotate the latch 254 about its pivot pin 256 which disengages the end hook 258 from the notch 242. Inasmuch as this action is performed with considerable speed, a resilient stop 268 is provided for limiting the movement of the latch 254 to insure that the latch 254 is not damaged. The disengagement of the end hook 258 from the notch 242 releases the rod 224. The compressed spring member 244 then moves the bracket 246 and the attached insert member 32 and rod 242 rearwardly to propel the insert member 32 from its mating to its non-mating position. Thus, the contact means 28 and 30 are disengaged so that the missile stages associated with the housings 13 and 15 may subsequently separate without damaging the contact means 28.

Referring to FIG. 10, the closure member 210 in this particular embodiment consists of a slidable ceramic or quartz phenolic shutter 268 having a plurality of apertures 270 therein. The shutter 268 is transversely slideable within the forward opening of the cavity 228 so that when the shutter 268 is in its open position, the apertures 270 are in alignment with the terminal socket members 202 to allow the pins 218 to pass therethrough into the sockets 202. A spring clip 272 is provided to move the shutter 268 to its closed position and biasly maintain it therein, wherein the apertures 270 are no longer in alignment with the socket members 202. This prevents access to the socket members 202.

Two additional apertures 274 are provided in the shutter 268 for the purpose of moving the shutter 268 to its open position. At least two alignment pins (not illustrated), which are longer than the pins 218, are provided on the insert member 32 for engaging the apertures 274 when the insert member 32 is being moved to its mating position. Upon initial engagement of the alignment pins with the apertures 274, the alignment pins are oriented such that they force the shutter 268 to its open position in opposition to the spring bias of the clip 272, thereby providing access to the socket members 202 for the pins 218. When the alignment pins are removed from the apertures 274, the shutter 268 is automatically moved to its closed position by the spring clip 272. Use of the shutter 268 in lieu of the previously described doors 70 permits the length of the extendable pins 220 as well as the overall connector 200 to be reduced.

Referring to FIG. 11, an expanded view of the contact means 30 utilizing an extendable pin member is shown. For purposes of illustration, the contact means 30 of the connector 200 in FIG. 9 will be described, although the features thereof are applicable to the other similar embodiments. As previously described, the contact means 30 includes an extendable portion 42 which preferably comprises an elongated pin 220. In the preferred form, the pin 220 is secured to a collar 276 to which the active contact pin 218 is also secured. The collar 276 is embedded in the insert block 33 by epoxy potting 278 for movement with the insert member 32. The terminal end of the pin 220 includes a pin terminal portion 222 which consists of an electrically conductive material similar to the main body portions of the pin 220 and the pin 218. The terminal portion 222 is in continual physical and electrical engagement with the electrically conductive socket member 214.

In preferred form, the pin 220 is coated with a layer of insulating material, preferably a polymer, between the collar 276 and the terminal portion 222. The pin portion 220 is coated by a polymeric insulating material to provide protection from condensation and other moisture which may be present within the cavity 226. Without such a coating, the close side-by-side juxtaposition of the plurality of pins 220 in the contact means 30 would enable a droplet of water from condensation to possibly short-circuit the contact means 30.

Referring now to FIGS. 12, 12A and 13-16, another embodiment of the present invention is shown illustrating the expandable contact portion 46. In this particular embodiment, the interstage connector 300 includes a first connector housing 13' and a second connector housing 15'. In this embodiment, the contact means 28 includes a terminal socket member 302 mounted within a fixed socket monoblock 304. Disposed about the entrance portion of the socket member 302 is a waveguide 306, and a hinged door 308, similar to the door 70 of FIGS. 3 and 4, is also provided. The contact means 28 are disposed within a central cavity 310 in the housing 13'.

The contact means 30 of the second connector housing 15' includes a terminal contact portion 38', an active contact portion 40 having a pin contact member 312, and an expandable portion 46. The contact means 30 are disposed within a central cavity 314 of the connector housing 15'. In this particular embodiment, the terminal contact portion 38' includes a socket member 316 and a pin member 318 engaged therein. The pin and socket members 318, 316 are embedded in a fixed monoblock 320. As in the previous embodiments, the insert member 32, having a shell portion 322, is provided for movement between mating and non-mating positions illustrated in FIGS. 12-14.

Figure 13:
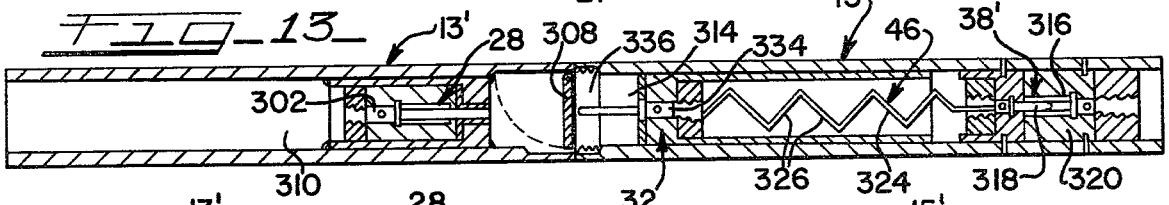
FIG. 13 is a sectional view taken substantially along line 13—13 of FIG. 12.
Figure 13:
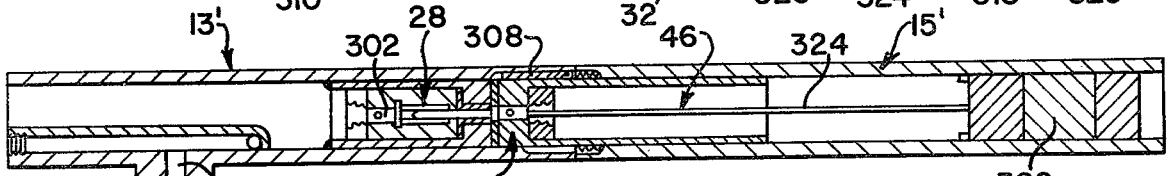
Figure 14:
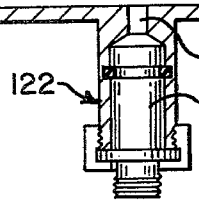
FIG. 14 is a sectional view taken substantially along line 14—14 of FIG. 12.
Figure 15:
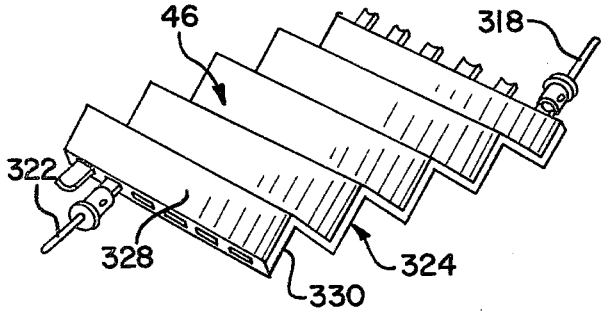
FIG. 15 is a perspective view of another embodiment of the extendable contact portions of the second contact means illustrated in FIGS. 12 and 13.

The extendable contact portion 36 includes a flexible conductor 324 which is in the form of a flat cable or tape with accordion-like folds. As illustrated in FIG. 13, the flexible conductor 324 is foldable along a plurality of folds 326 when the insert member 32 is in its non-mating position. When the insert member 32 is moved to its mating position, as illustrated in FIG. 14, the flexible conductor 324 expands to accommodate such movement. As particularly seen in FIG. 15, the flexible conductor 324 includes a plurality of conductors 328 which are embedded in a flexible insulating material 330. At the rear end of each conductor 328 is one of the pin members 318 for fixed engagement within a terminal socket member 316. In addition, a pin member 332 projects from the forward end of each of the conductors 328 and is firmly mounted within a socket 334 which is embedded in the movable insert 32. Thus, the flexible conductor 324 provides continuous electrical connection between each active pin contact member 312 and each socket member 316 as the insert member 32 is moved between its mating and non-mating portions. In addition, an EMI bellows 336 is provided immediately adjacent the forward surface 23' of the housing 15' to provide additional shielding for the contact means 28 and 30.

The latching and separation mechanisms 35' and 37', respectively, are disposed on either side of the respective central cavities 310 and 314 of the housings 13' and 15', similar to the embodiment of FIG. 9. In this particular embodiment, each connector housing 13' includes a cavity 338 on either side of the central cavity 310, while each connector housing 15' includes a cavity 340 on either of its central cavity 314. Disposed within each peripheral cavity 340 is an elongated rod 342 having a knob member 344 at its forward end formed by an annular groove 346. Each rod 342 extends rearwardly beyond the cavity 340 into an enclosure 348 and includes a locking knob 350 disposed on its rearward end. A bracket 352 is also disposed within the cavity 340 and is secured to the rod 342. The bracket 352 extends through a slot 354 into the central cavity 314 to engage the shell 322 of the insert member 32. In this manner, the rod 342, the bracket 352 and the insert member 32 are linked together for simultaneous movement.

Disposed within each cavity 338 of the connector housing 13' is a latching arm 356 which is pivotable about a pin 358. Disposed at the end of the arm 356 is a camming member 360, and an integral latching member 362 projects from the arm 356 intermediate the camming member 360 and the pivot pin 358. The outermost portion of each cavity 338 is defined by a wall 364, and orifices 366 and 368 are provided therein through which the camming member 360 and the latching member 362, respectively, may pass into a longitudinal bore 374. A spring member 370 maintains the arm 356 in a biased position whereby the camming and latching members 360 and 362 project into the bore 374.

Once the connector housings 13' and 15' are fully engaged, the rod 342 is moved longitudinally thorugh a bore 372 which communicates with the cavity 342 and into the bore 374. The rod 342 is so moved by removing a cover portion of the wall forming the enclosure 348 and pressing against the locking knob 350. As the knob 344 at the free extendable end of the rod 342 passes through the bore 374, it engages a camming surface 376 disposed on the latching member 362 to move the arm 356 in a direction against the bias created by the spring member 370. This forces the latching member 362 back through its orifice 368 until the annular recess 346 on the rod 342 is aligned therewith. At this moment, the latch 362 is moved by the bias of spring member 370 to engage the latching member in the recess 346. In this manner, the insert member is moved from its non-mating to its mating position to interengage the contact means 28, 30, and the contact means 28 and 30 are maintained in such interengagement by the latching of the member 362 within the recess 346. In addition, a freely movable piston 378 is provided within the bore 374 between the orifices 366 and 368 for use in disengaging the contact means 28 and 30 as described below.

To disengage the contact means 28 and 30, the separating or quick disconnect mechanism 37' is provided and includes a source 122 for generating a pressurized fluid, preferably a squib 124 as previously described. A plurality of ducts 380, 381 and 382 are provided in communication with each other to direct the gas from the squib 124 into the bore 374 between the piston 378 and the latch 362. When the gas is so delivered by the squib 124, the expanding gas forces the freely movable piston 378 against the camming member 360 to force the camming member 360 back through the aperture 366. This moves the arm 356 so as to retract the latching member 362 from engagement within the recess 346. A resilient spring member 384 is provided within the second connector housing 15' between the bracket 352 and the forward surface 23' and is in a compressed position when the insert member is in its mating position, thereby creating a bias force against the bracket 352. When the latch 362 is removed from the recess 346, the spring member 384 moves the bracket 352 and the insert member 32 rearwardly so as to move the insert member to its non-mating position and disengage the contact means 28 and 30.

Figure 12:
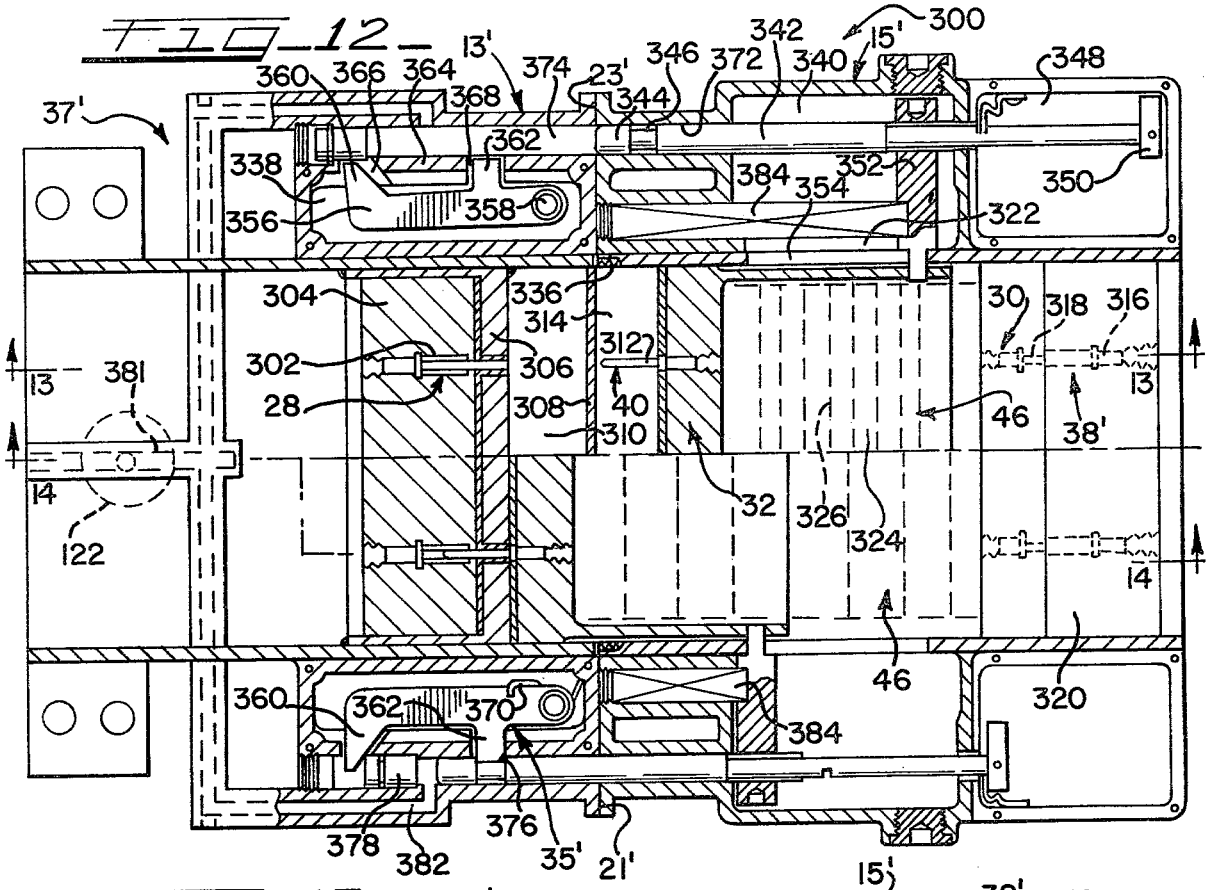
FIG. 12 is a sectional view, with some parts in elevation, of still another embodiment of a connector constructed in accordance with the present invention and illustrating the contact means in both engaged and disengaged positions.

Referring to FIG. 12A, a slightly different arrangement of the latching and separating or quick disconnect mechanism 35' and 37' of FIG. 12 is illustrated. In this particular arrangement, the ducts 390 leading from the squib 124 are directed through the back shell 392 of the connector housing 13' rather than as piping disposed exterior to the housing 13' as illustrated in FIG. 12. In addition, the latching member 362' is not integral with the arm 356 but is a separate member connected to the arm 356 by a pin and slot arrangement 394. The operation of the latching and separation mechanisms 35' and 37' of FIG. 12A is the same as that of FIG. 12 except that the pin and slot arrangement 394 provides some freedom of movement for the latch 362' relative to the arm 356 to provide easier insertion and withdrawal thereof through the aperture 368.

Figure 16:
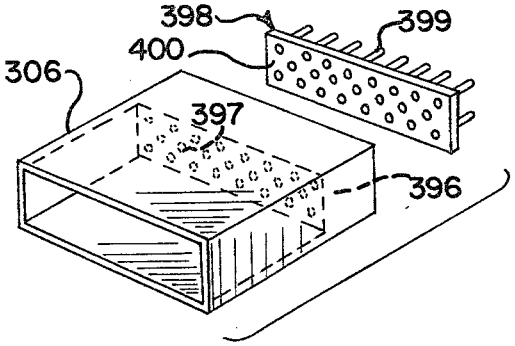
FIG. 16 is an exploded perspective view of a waveguide member utilized in the connector embodiment illustrated in FIG. 12.

Referring to FIG. 16, the waveguide 306 of FIG. 12 is illustrated in detail. The waveguide 306 is representative of all the waveguide embodiments illustrated herein and includes a block 396 having a plurality of apertures 397 longitudinally disposed therein. The apertures are arranged for alignment with the socket members 302 (see FIG. 12) to permit interengagement of the contact means 28 and 30. The block 396 is constructed of metal with each aperture 397 having a ratio of length to diameter of 3 to 1. The function and purpose of the waveguide 306 is known in the art and is utilized herein to attenuate electromagnetic pulses and electromagnetic interference. Inasmuch as the block 396 is constructed from metal, the pins 312 which must pass therethrough to engage the sockets 302 must be electrically insulated therefrom. Otherwise, the circuits of the contact means 28 and 30 will be shorted. Therefore, an integrally molded waveguide insulation member 398 is provided which consists of a plurality of thin extrusion sleeves 399 mounted to a base 400. The sleeves 399 are adapted for lining the inner cylindrical surfaces of the apertures 398. The waveguide insulation member 398 may be constructed from any electrically insulating material. The sleeves 399 thus line the inner surfaces of the apertures 397 and thereby prevent direct contact between the pins 312 and the waveguide block 396. It should be noted that the EMI and EMP shielding arrangements of the various embodiments of the present invention are designed to protect the contact means 28 and 30 up to sixty and preferably ninety decibels.

As can be seen from the above, the present invention provides an interstage connector whereby the contact elements thereof may be engaged and disengaged independently of the engagement and disengagement of the connector component housings. This is especially useful in interconnecting the circuitry of two adjacent missile stages wherein the planes of separation of the missile stages and the connector housings must be the same. Inasmuch as the present invention permits independent disengagement of the contact means of the interstage connector, simultaneous separation of the connector housings and the missile stages along any line relative to the connector axis will not damage the electrical contact elements of the connector. Furthermore, it will not damage the EMI, EMP and environmental shielding of the connector housings. It will be appreciated that while the particular embodiments of the present invention are described in association with the interconnection of circuits of adjacent missile stages, the electrical connector of the present invention may be utilized in a wide variety of other situations where it is desired to be able to engage and/or disengage the contact elements of the connector housings independently of the engagement or disengagement of the connector housings.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

What I claim is:

1. An electrical connector comprising:

a first housing supporting first contact means, said first housing having a recessed mating end;

a second housing adapted for engagement with said recessed mating end of said first housing and supporting second contact means engageable with said first contact means; and actuator means for engaging and disengaging said first and second contact means independently of the engagement and disengagement of said housings, said actuator means including latch means for moving said second contact means into said recessed mating end of said first housing to interengage said first and second contact means subsequent to the engagement of said first and second housings and quick disconnect means for moving said second contact means out of said recessed mating end of said first housing to disengage said first and second contact means prior to the disengagement of said housings.

2. The electrical connector as described in claim 1, wherein said actuator means includes a movable insert member disposed within said second housing for movement between mating and non-mating positions, and wherein said second contact means comprises a fixed terminal portion, an active contact portion carried by said insert member and engageable with said first contact means, and an extendable portion for maintaining continuous electrical connection between said active and terminal portions during movement of said insert member.

3. The electrical connector as described in claim 2, wherein said extendable portion comprises at least one elongated contact member projecting from said insert member and slidingly engageable with said terminal portion as said insert member moves between said mating and non-mating positions.

4. The electrical connector as described in claim 2, wherein said extendable portion comprises a flexible conductor interconnecting said active and terminal portions, said flexible conductor being foldable for accommodating movement of said insert member.

5. The electrical connector as described in claim 1, wherein said actuator means includes a movable insert member supporting said second contact means and disposed within said second housing for movement between mating and non-mating positions and said latch means is adapted for moving said insert member to said mating position for interengaging said first and second contact means.

6. The electrical connector as described in claim 5, wherein said latch means comprises at least one elongated member extendable from one said housing into the other said housing and having a first latching member disposed on the extendable end thereof, and at least one second latching member disposed in said other said housing and adapted for firmly engaging one said first latching member when the elongated member is extended into said one said housing, the longitudinal movement of each said elongated member in one direction effecting movement of said insert member from said non-mating position to said mating position to firmly interengage said first and second contact means, said engaged first and second latching members maintaining said contact means in firm interengagement.

7. The electrical connector as described in claim 6, wherein each said elongated member is longitudinally extendable from said first housing into said second housing for interengagement of said first and second latching members, said second latching member being secured to said insert member, said elongated member being longitudinally movable back into said second housing after interengagement of said latching members to move said insert member to its mating position and interengage said contact means.

8. The electrical connector as described in claim 6, wherein each said elongated member is longitudinally extendable from said second housing into said first housing for interengagement of said latching members and is secured for longitudinal movement with said insert member, said second latching member being disposed in said first housing.

9. The electrical connector as described in claim 5, wherein said quick disconnect means comprises source means for generating a pressurized fluid, means for distributing said fluid to said first housing, and driver means movable by said fluid for disengaging said first and second contact means by moving said insert member from said mating position to said non-mating position.

10. An electrical connector comprising:

a first housing supporting first contact means therewithin;

a second housing supporting second contact means therewithin engageable with said first contact means when said first and second housings are brought into engagement; and actuator means including a movable insert member disposed within said second housing for movement between mating and non-mating positions, said second contact means including a terminal portion, an active contact portion carried by said insert member for electrical engagement with said first contact means when said insert member is in said mating position, and an extendable portion for maintaining continuous electrical connection between said active and terminal portions as said insert member moves between said mating and non-mating position, said actuator means including latch means for interengaging said first and second contact means subsequent to the engagement of said first and second housings and quick disconnect means for disengaging said first and second contact means prior to the disengagement of said housings.

11. The electrical connector as described in claim 10, wherein said first housing includes a forward fastening end portion disposed therewithin, and wherein said insert member may be positioned in either said mating position with said insert member disposed within said forward fastening end portion or in said non-mating position with said insert member disposed within said second housing.

12. The electrical connector as described in claim 10, wherein said extendable means comprises an elongated contact member projecting from said insert member toward said terminal portion and adapted for continuous sliding engagement with said terminal portion as said insert member is moved between said mating and non-mating positions.

13. The electrical connector as described in claim 12, wherein said terminal portion comprises at least one elongated socket member, and said extendable elongated member comprises at least one elongated pin member disposed within one said socket member and slidingly movable therewithin as said insert member is moved between said mating and non-mating positions.

14. The electrical connector as described in claim 10, wherein said extendable means comprises flexible conductor means interconnecting said active and terminal contact portions.

15. The electrical connector as described in claim 14, wherein said flexible conductor means includes accordion-like folds adapted for extension and contraction to accommodate movement of said insert member.

16. The electrical connector as described in claim 10, wherein said latch means comprises at least one elongated member extendable from one said housing into the other said housing and having a first latching member disposed on the extendable end thereof, and at least one second latching member disposed in said other said housing and adapted for firmly engaging said first latching member when said elongated member is extended into said one said housing, the longitudinal movement of each said elongated member in one direction effecting movement of said insert member from said non-mating position to said mating position to firmly interengage said active contact portion and first contact means, said engaged first and second latching members locking said contact means in firm interengagement.

17. The electrical connector as described in claim 10, wherein said quick disconnect means comprises source means for generating a pressurized fluid, means for distributing said fluid to said first housing, and driver means movable by said fluid for disengaging said active contact portion and first contact means by moving said insert member from said mating position to said non-mating position.

18. The electrical connector as described in claim 10, wherein said first and second housings include means for shielding said first and second contact means from electromagnetic interference, electromagnetic pulses and environmental contaminants.

19. The electrical connector as described in claim 10, wherein said first contact means comprises at least one socket contact element, and wherein said active contact portion comprises at least one pin contact element matingly engageable within one said socket contact element.

20. An electrical connector comprising:

a first housing having a forward fastening end portion with first contact means disposed therewithin, said first contact means including at least one first contact member;

a second housing having a fixed rear portion and a forward fastening end portion adapted for engagement with said first housing forward fastening end portion;

a movable insert member disposed within said second housing for movement between a mating position and a non-mating position;

second contact means disposed within said second housing and adapted for electrical engagement with said first contact means when said insert member is in said mating position and said first and second housings are brought into engagement, said second contact means including a terminal portion disposed in said fixed rear portion, at least one active second contact member carried by said insert member and adapted for engagement with said first contact member, and an extendable portion for maintaining continuous electrical connection between said at least one second contact member and said terminal portion as said insert member is moved between said mating and non-mating positions;

latch means for moving said insert member to said mating position and for maintaining interengagement of said first and second contact members; and quick disconnect means for disengaging said first and second contact members prior to disengagement of said housings.

21. The electrical connector as described in claim 20, wherein said extendable portion comprises an elongated contact member projecting from each said second contact member and slidingly engageable with said terminal portion as said insert member is moved between said mating and non-mating positions.

22. The electrical connector as described in claim 21, wherein said terminal portion comprises at least one elongated socket member, and said elongated contact member comprises an elongated pin member movable within said socket member and including a terminal end for continuous electrical contact with the interior of said socket member as said insert member is moved between said mating and non-mating positions.

23. The electrical connector as described in claim 22, wherein that portion of said elongated pin member between said terminal end and said insert member includes an electrically insulating coating disposed thereabout.

24. The electrical connector as described in claim 20, wherein said extendable portion comprises a flexible conductor electrically interengaging each said second contact member and said terminal portion, said flexible conductor being foldable for accommodating movement of said insert member between said mating position and said non-mating position.

25. The electrical connector as described in claim 20, wherein said latch means comprises at least one elongated member extendable from one said housing into the other said housing and having a first latching member disposed on the extendable end thereof, and at least one second latching member disposed in said other said housing and adapted for firmly engaging one said first latching member when said elongated member is extended into said one said housing, the longitudinal movement of each said elongated member in one direction effecting movement of said insert member from said non-mating position to said mating position to firmly interengage said first and second contact members, said engaged first and second latching members locking said contact means in firm interengagement.

26. The electrical connector as described in claim 20, wherein said separation means comprises source means for generating a pressurized fluid, means for distributing said fluid to said first housing, said driver means movable by said fluid for disengaging said first and second contact members by moving said insert member from said mating position to said non-mating position.

27. The electrical connector as described in claim 20, wherein said first and second housings include means for shielding said first and second contact means from electromagnetic interference, electromagnetic pulses and environmental contaminants while said housings are engaged and during disengagement thereof.

28. An electrical connector assembly for interconnecting adjacent guided missile stages comprising:

a first connector housing secured to one said missile stage and supporting first contact means therewithin, said first housing having a recessed mating end;

a second connector housing secured to the adjacent missile stage and adapted for engagement with said recessed mating end of said first connector housing, said second connector housing supporting second contact means therewithin engageable with said first contact means; and actuator means for physically and electrically engaging and disengaging said first and second contact means independently of the engagement and disengagement of said housings, said actuator means including means for moving said contact means into said recessed mating end of said first housing to interengage said first and second contact means subsequent to the engagement of said first and second housings and quick disconnect means for moving said second contact means out of said recessed mating end of said first housing to disengage said first and second contact means prior to the disengagement of said housings.

29. The connector assembly as described in claim 28, wherein said latch means engages and disengages said first and second contact means along a line substantially parallel with the central axis of the interconnected housings.

30. The connector assembly as described in claim 29, wherein said actuator means includes a movable insert member disposed within said second housing for movement along a line substantially parallel with the central axis of said second housing, and wherein said second contact means comprises a terminal portion, an active contact portion carried by said insert member and axially engageable with said first contact means, and an extendable portion for maintaining continuous electrical connection between said active and terminal portions during movement of said insert member.

31. The connector assembly as described in claim 30, wherein the movement of said insert member is independent of the engagement and disengagement of said first and second housings to permit said housings to be disengaged along a line not substantially parallel to said central axis.

32. In an electrical connector having a first housing supporting first contact means and a second housing adapted for engagement with said first housing and supporting second contact means engageable with said first contact means, the improvement wherein said connector further comprises latch means for moving an insert member disposed in said second housing to a mating position to interengage said first and second contact means independently of the engagement and disengagement of said housings and for locking said contact means in interengagement, and quick disconnect means separate from said latch means for disengaging said first and second contact means prior to the disengagement of said housings.

33. An electrical connector comprising:

a first housing supporting first contact means, said first housing having a recessed mating end;

a second housing adapted for engagement with said recessed mating end of said first housing and supporting second contact means engageable with said first contact means; and actuator means for engaging and disengaging said first and second contact means independently of the engagement and disengagement of said housings wherein said actuator means comprises a movable insert member supporting said second contact means and disposed within said second housing for movement into and out of said recessed mating end of said first housing between mating and non-mating positions, latch means for moving said insert member into said recessed mating end of said first housing into said mating position for interengaging said first and second contact means, and separation means for moving said second contact means out of said recessed mating end of said first housing for disengaging said first and second contact means prior to disengagement of said housings.

34. The electrical connector as described in claim 33, wherein said latch means comprises at least one elongated member extendable from one said housing into the other said housing and having a first latching member disposed on the extendable end thereof, and at least one second latching member disposed in said other said housing and adapted for firmly engaging one said first latching member when said elongated member is extended into the one said housing, the longitudinal movement of each said elongated member in one direction effecting movement of said insert member from said non-mating position to said mating position to firmly interengage said first and second contact means, said engaged first and second latching members maintaining said contact means in firm interengagement.

35. The electrical connector as described in claim 33, wherein each said elongated member is longitudinally extendable from said first housing into said second housing for interengagement of said first and second latching members, said second latching member being secured to said insert member, said elongated member being longitudinally movable back into said second housing after interengagement of said latching members to move said insert member to its mating position and interengage said contact means.

36. The electrical connector as described in claim 33, wherein each said elongated member is longitudinally extendable from said second housing into said first housing for interengagement of said latching members and is secured for longitudinal movement with said insert member, said second latching member being disposed in said first housing.

37. The electrical connector as described in claim 33, wherein said separation means comprises source means for generating a pressurized fluid, means for distributing said fluid to said first housing, and driver means movable by said fluid for disengaging said first and second contact means by moving said insert member from said mating position to said non-mating position.

38. An electrical connector comprising:

a first housing supporting first contact means therewithin;

a second housing supporting second contact means therewithin engageable with said first contact means when said first and second housings are brought into engagement; and actuator means including a movable insert member disposed within said second housing for movement between mating and non-mating position, said second contact means including a terminal portion, an active contact portion carried by said insert member for electrical engagement with said first contact means when said insert member is in said mating position, and an extendable portion for maintaining continuous electrical connection between said active and terminal portions as said insert member moves between said mating and non-mating positions wherein said actuator means further comprises latch means for moving said insert member to said mating position and for maintaining interengagement of said active contact portion and said first contact means, and separation means for disengaging said active contact portion and said first contact means prior to disengagement of said housings.

39. The electrical connector as described in claim 38, wherein said latch means comprises at least one elongated member extendable from one said housing into the other said housing and having a first latching member disposed on the extendable end thereof, and at least one second latching member disposed in said other said housing and adapted for firmly engaging said first latching member when said elongated member is extended into said one said housing, the longitudinal movement of each said elongated member in one direction effecting movement of said insert member from said non-mating position to said mating position to firmly interengage said active contact portion and first contact means, said engaged first and second latching members locking said contact means in firm interengagement.

40. The electrical connector as described in claim 38, wherein said separation means comprises source means for generating a pressurized fluid, means for distributing said fluid to said first housing, and driver means movable by said fluid for disengaging said active contact portion and first contact means by moving said insert member from said mating position to said non-mating position.

41. An electrical connector comprising:

a first housing supporting first contact means therewithin;

a second housing supporting second contact means therewithin engageable with said first contact means when said first and second housings are brought into engagement, said first and second housings including means for shielding said first and second contact means from electromagnetic interference, electromagnetic pulses and environmental contaminants; and actuator means including a movable insert member disposed within said second housing for movement between mating and non-mating positions, said second contact means including a terminal portion, an active contact portion carried by said insert member for electrical engagement with said first contact means when said insert member is in said mating position, and an extendable portion for maintaining continuous electrical connection between said active and terminal portions as said insert member moves between said mating and non-mating positions.

42. An electrical connector comprising:

a first housing having a forward fastening end portion with first contact means disposed therewithin, said first contact means including at least one first contact member;

a second housing having a fixed rear portion and a forward fastening end portion adapted for engagement with said first housing forward fastening end portion;

a movable insert member disposed within said second housing for movement between a mating position and a non-mating position;

second contact means disposed within said second housing and adapted for electrical engagement with said first contact means when said insert member is in said mating position and said first and second housings are brought into engagement, said second contact means including a terminal portion having at least one elongated socket member, said terminal portion disposed in said fixed rear portion, at least one active second contact member carried by said insert member and adapted for engagement with one said first contact member, and an extendable portion for maintaining continuous electrical connection between said at least one second contact member and said terminal portion as said insert member is moved between said mating and non-mating positions, said extendable portion comprising an elongated pin member projecting from each said second contact member being movable within said socket member and including a terminal end for continuous electrical contact with the interior of said socket member as said insert member is moved between said mating and non-mating positions;

latch means for moving said insert member to said mating position and for maintaining interengagement of said first and second contact members; and separation means for disengaging said first and second contact members prior to disengagement of said housings.

43. The electrical connector as described in claim 42, wherein that portion of said elongated pin member between said terminal end and said insert member includes an electrically insulating coating disposed thereabout.

44. The electrical connector as described in claim 43, wherein said extendable portion comprises a flexible conductor electrically interengaging each said second contact member and said terminal portion, said flexible conductor being foldable for accommodating movement of said insert member between said mating position and said non-mating position.

45. An electrical connector comprising:

a first housing having a forward fastening end portion with first contact means disposed therewithin, said first contact means including at least one first contact member;

a second housing having a fixed rear portion and a forward fastening end portion adapted for engagement with said first housing forward fastening end portion said first and second housings including means for shielding said first and second contact means from electromagnetic interference, electromagnetic pulses and environmental contaminants while said housings are engaged and during disengagement thereof;

a movable insert member disposed within said second housing for movement between a mating position and a non-mating position;

second contact means disposed within said second housing and adapted for electrical engagement with said first contact means when said insert member is in said mating position and said first and second housings are brought into engagement, said second contact means including a terminal portion disposed in said fixed rear portion, at least one active second contact member carried by said insert member and adapted for engagement with one said first contact member, and an extendable portion for maintaining continuous electrical connection between said at least one second contact.

* * * * *